United States Patent [19]

Nemoto

[11] Patent Number: 4,588,228

[45] Date of Patent: May 13, 1986

[54] PAN-TYPE VEHICLE SEAT BACK MOUNTED TO A RECLINING MECHANISM

[75] Inventor: Akira Nemoto, Tokyo, Japan

[73] Assignee: Tachikawa Spring Co., Ltd., Japan

[21] Appl. No.: 520,642

[22] Filed: Aug. 5, 1983

[51] Int. Cl.[4] ..... A47C 7/02

[52] U.S. Cl. ..... 297/452; 297/354; 297/451

[58] Field of Search ..... 297/452, 354, 378, 451, 297/DIG. 2

[56] References Cited

U.S. PATENT DOCUMENTS 1,830,119 11/1931 Marshall ..... 297/378
2,638,150 5/1953 May ..... 297/452
4,368,917 1/1983 Urai ..... 297/DIG. 2 X

FOREIGN PATENT DOCUMENTS 94637 10/1962 Denmark ..... 297/452
2003661 8/1971 Fed. Rep. of Germany ..... 297/452
1152924 5/1969 United Kingdom ..... 297/354

*Primary Examiner*—William E. Lyddane
*Assistant Examiner*—José V. Chen
*Attorney, Agent, or Firm*—Cushman, Darby & Cushman

[57] ABSTRACT

A vehicle seat is disclosed in which the movable arm members of its reclining mechanism are mounted to reinforcing members provided inside a back frame of a pan-type structure. Bolts for fixing the movable arm members are not projected outside the back frame.

7 Claims, 7 Drawing Figures

PAN-TYPE VEHICLE SEAT BACK MOUNTED TO A RECLINING MECHANISM

BACKGROUND OF THE INVENTION

1. Field of the Invention

The present invention relates to a vehicle seat, and more particularly to an automobile seat having an improved mounting structure for securing a movable arm member of a reclining mechanism to a back frame constituting a seat back. The present invention is advantageous in that it is safer as compared to conventional vehicle seats since bolts for fixing the movable arm member do not project beyond the outer surface of the back frame and also in that it can eliminate the possibility of damaging the outer peripheral surface of the back frame when the movable arm member is fixed to the back frame.

2. Description of the Prior Art

In conventional vehicle seats in which there is mounted a reclining mechanism between a seat cushion and a seat back so as to be able to incline the seat back, and the back frame of the seat back has a pan-type structure formed of synthetic resin or steel plate, as shown in FIG. 1(A), the back frame (1) includes a rear surface (2) which is generally rectangular. On the periphery of the rear surface (2) there are provided upper, lower, right and left walls (4*a*), (4*b*), (4*c*) and (4*d*) and also at the convenient positions of the rear surface (2) there are arranged reinforcing ribs (5*a*), (5*b*) which extend longitudinally and transversely, respectively.

Also, with the end portions (6*a*) of the reclining mechanisms (6) being respectively fixed to a cushion frame, a pair of movable arm members each on a free hinge (not shown) are respectively abutted against the inner surfaces of the right and left walls (4*c*) and (4*d*) through grooves (7),(7) cut in the lower wall (4*b*) of the back frame (1) in a mutually opposing relation, and thereafter the movable arm members (6*b*) are respectively fastened to the right and left walls (4*c*), (4*d*) by means of bolts (9) and nuts (10) to provide an assembly.

However, when the movable arm members (6*b*) of the reclining mechanism (6) are assembled to the back frame (1) in the above described manner, as shown more clearly in FIG. 1(B), it is necessary to tighten the bolts (9) from the side of the outer surfaces of the right and left wall (4*c*) and (4*d*), which involves several disadvantages. For example, there is a possibility that the outer surface of the back frame (1) may be damaged by the tip end of a tool during the assembling operation. Also, the bolts may be dangerous to a seat occupant because the head portions of the bolts (9) project beyond the outer surfaces of the right and left walls (4*c*) and (4*d*). Moreover, the bolts used must be surface-treated with some high quality processes, such as a chrome plating so that the aesthetic appearance of the seat will not be impaired. Such processes however result in increased costs.

SUMMARY OF THE INVENTION

Thus, the present invention aims at overcoming the drawbacks mentioned above which have been present in the prior art vehicles seats. According to the invention, there are disclosed herein four embodiments each having an improved mounting structure for securing a pair of movable arm members of a reclining mechanism to a back frame; each of the embodiments is safer as compared to conventional vehicle seats in that bolts used for fixing the movable arm members to the back frame are not projected ouside the back frame and at the same time each embodiment can also eliminate the possibility of the back frame being lowered in strength or being damaged due to the mounting of the movable arm members to the back frame.

In brief, the above and other objects, features and advantages of the present invention are attained by providing a vehicle seat in which the movable arm members of its reclining mechanism are mounted to reinforcing members provided inside a back frame of a pan-type structure. Thus, with the present invention, the bolts for fixing the movable arm members are not projected outside the back frame, nor is it necessary to drill holes for securing the movable arm members in the peripheral walls of the back frame unlike in the above described prior art, which can eliminate the possibility of the back frame being degraded in strength or being damaged.

In addition, the reinforcing members provided inside the back frame are reinforcing ribs each of which is formed to have an enlarged thickness as as to enhance its reinforcing efftect.

DETAILED DESCRIPTION OF THE EMBODIMENTS

Figure 1A:
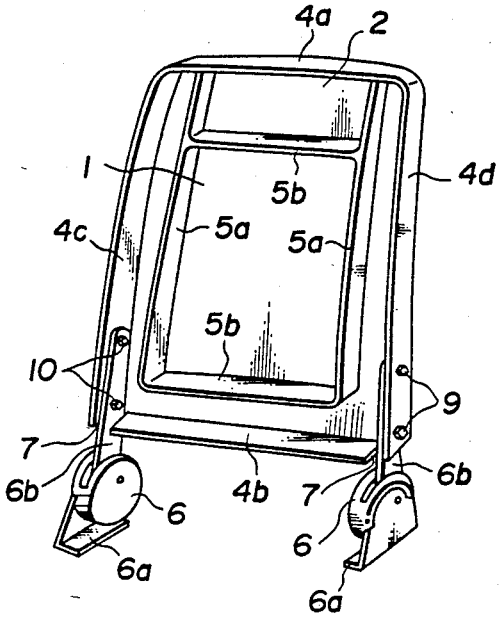
FIG. 1(A) (PRIOR ART)
FIG. 1(A) is a perspective view illustrating an assembly of a back frame and a reclining mechanism in a conventional vehicle seat.
Figure 2:
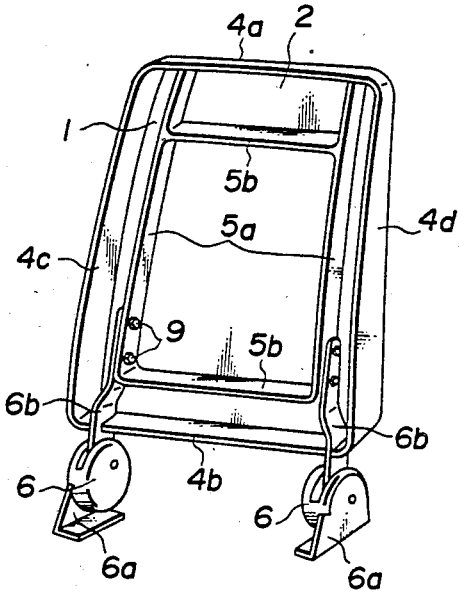
FIG. 2 is a perspective view illustrating an assembly of a back frame and a reclining mechanism according to the present invention.
Figure 1B:
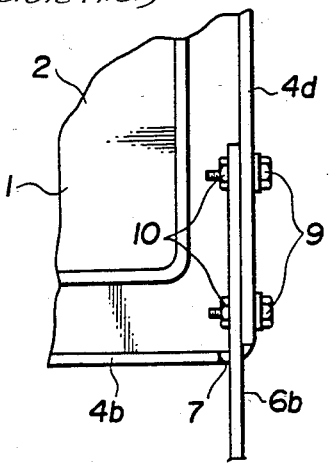
FIG. 1(B) (PRIOR ART)
FIG. 1(B) is an enlarged front view of the main parts of the assembly shown in FIG. 1(A)

We will now describe several embodiments according to the present invention in detail with reference to FIGS. 2–6. The same parts as illustrated in both FIGS. 1(A) and 1(B) are designated by the same numerals in FIGS. 1(A) and 1(B), and the repeated description of them is omitted.

Figure 3:
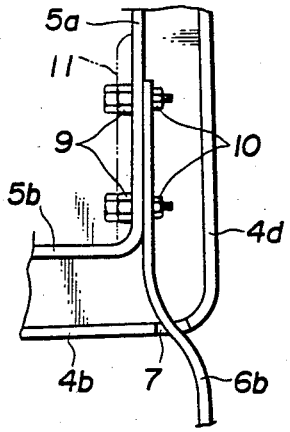
FIG. 3 is an enlarged front view illustrating the main parts of the assembly shown in FIG. 2, or a first embodiment of the invention.
Figure 4:
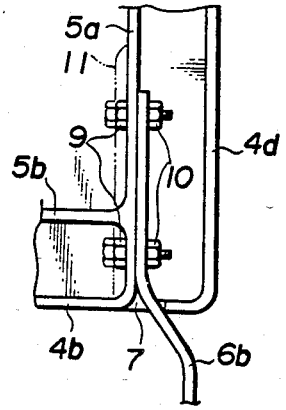
FIG. 4 is an enlarged front view similar to that in FIG. 3, but illustrating a second embodiment of the invention; and, FIGS. 5 and 6 are enlarged front view respectively also similar to that in FIG. 3, but illustrating a third and fourth embodiments respectively.

According to the present invention, a pair of reclining mechanisms (6) and a pair of movable arm members (6*b*), each of which is included in one of the reclining mechanisms and is mounted on a free hinge (not shown), are positioned outside reinforcing ribs (5*a*) in their respective opposing relations, and thereafter they are fastened and assembled together by bolts (9) and nuts (10). FIGS. 3 and 4 illustrate two embodiments of thus assembled portions respectively. In a first embodiment shown in FIG. 3, each of the movable arm members (6*b*) is fixed to the respective reinforcing ribs (5*a*). For enhancing the reinforcing effect, the portions of the reinforcing ribs (5*a*) which serve to fix the movable arm members may be formed to have an enlarged thickness (11), as shown by a two-dot chain line in FIGS. 3 and 4.

Thus, with the above mentioned arrangements of the invention, several practical effects can be obtained; for example, safety is ensured by the fact that the bolts for fixing the movable arms of the reclining mechanisms are never projected outside a back frame (1); it is not necessary to use decorative bolts for the purpose of the aesthetic appearance of the seat; since the assembling operation of the movable arm members to the back frame is carried out inside the back frame, there is no possibility that the outer peripheral surfaces of the back frame are damaged; and, a fine surface treating process which is rather expensive can be eliminated, resulting in decrease in the cost.

FIG. 4 illustrates a second embodiment of the present invention in which the right and left reinforcing ribs (5*a*) are arranged to extend continuously to the lower wall (4*b*) of the back frame (2), a groove (7) is cut between the right and left walls (4*c*) and (4*d*), and the reinforcing ribs (5*a*) and the movable arm members (6*b*) of the reclining mechanisms (6) are fixed to the reinforcing ribs (5*a*). In this embodiment, similarly as in the embodiment shown in FIG. 3, the thickened portions (11) may be provided in the regions of the reinforcing ribs (5*a*) where the ribs fix the movable arm members thereto, so that an enhanced reinforcement can be attained.

Figure 5:
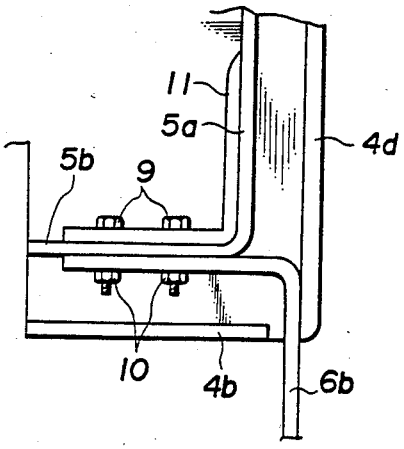

FIG. 5 illustrates a third embodiment of the present invention, in which each of the movable arm members (6*b*) of the reclining mechanisms (6) is formed to be bent at right angles, a lower, laterally extending reinforcing rib (5*b*) is provided with an enlarged or thickened portion (11), and both of the arm member and the rib are fixed together by bolts (9) and nuts (10).

Figure 6:
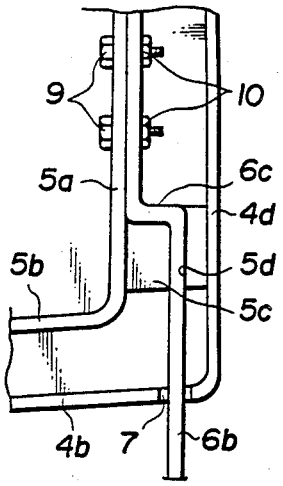

FIG. 6 illustrates a fourth embodiment of the present invention, wherein each of the movable arm members (6*b*) is provided at its one region with a step portion (6*c*), the movable arm member (6*b*) is inserted through a projection (5*c*) integrally formed on the rear surface (2) of the back frame (1) by means of a groove (5*d*) in this projection (5*c*) while the step portion (6*c*) is abutted against the projection (5*c*) to hold and position the movable arm member, whereby the movable arm member (6*b*) can be easily mounted onto the reinforcing rib (5*a*).

Although in each of the above mentioned embodiments the movable arms of the reclining mechanism are mounted onto the reinforcing members such as reinforcing ribs or reinforcing frames, means for securing and fastening the movable arm members within the upper, lower, right and left walls (4*a*), (4*b*), (4*c*) and (4*d*) of the back frame (1) may also be provided integrally in the reinforcing ribs, reinforcing frames, or upper, lower, right and left walls.

It should be also understood that other various changes or modifications of the parts are possible within the scope of the invention. When the back frame is cantilevered, a movable arm member on a free hinge can also be mounted in the same manner as described above, and thus its explanation may be omitted here.

From the foregoing description, one skilled in the art can easily ascertain the essential characteristics of the present invention, and, without departing from the spirit and scope thereof, can make various changes and modifications of the invention to adapt it to various usages and conditions.

What is claimed is:

1. A vehicle seat comprising: a seat back frame having a substantially flat rear surface and including a bottom wall and a pair of opposing side walls integral with and upwardly extending from said rear surface, said bottom wall and pair of side walls together defining therebetween a recessed interior space, and means defining a plurality of longitudinal and transverse reinforcing ribs on said flat surface and disposed within said interior space for structurally reinforcing said seat back frame, wherein said reinforcing ribs define, together with a respective opposing one of said bottom and side walls, a mounting space, and wherein said bottom wall includes a pair of spaced-apart grooves disposed substantially parallel to said side walls;

a pair of reclining mechanisms each including a movable arm to permit reclination of seat back, each said movable arm being accepted within a respective groove and extending into said mounting space so that one end portion of each said movable arm is adjacently positioned relative to a predetermined said reinforcing ribs; and securing bolt means for rigidly joining each said movable arm to said predetermined said reinforcing ribs, wherein a portion of said securing bolt means is retained in said mounting space while another portion of said securing bolt means is retained in said interior space, said bottom wall and side walls thereby concealing same.

2. The vehicle seat as in claim 1 wherein each said movable arm member includes a vertical arm accepted within said respective groove and a transverse arm perpendicular to said vertical arm, and wherein said securing means secures said transverse arm to a respective transverse reinforcing rib.

3. The vehicle seat as in claim 1 wherein said seat back frame includes a pair of projection members disposed in said mounting space between opposing ones of said reinforcing ribs and said side walls, said projection members each defining a stepped groove therein, and wherein each said movable arm includes means defining a stepped portion in registry with said stepped groove to retain each said movable arm in its respective projection member.

4. The vehicle seat as in claim 1 wherein said predetermined said reinforcing ribs each include a thickened portion adjacent said securing means for fixing said movable arm members thereto and to provide structural reinforcement for said securing means.

5. The vehicle seat as in claim 4 wherein said reinforcing ribs integrally formed with said bottom wall of said seat back frame.

6. The vehicle seat as recited in claim 1 wherein each said movable arm member includes a perpendicular bend portion to establish a transverse arm, and wherein said securing means joins said transverse arm to a transversely extending one of said reinforcing ribs.

7. The vehicle seat as in claim 1 wherein said seat back frame consists essentially of a synthetic resin.

* * * * *